United States Patent [19]

Takeuchi

[11] Patent Number: 4,635,026

[45] Date of Patent: Jan. 6, 1987

[54] PTC RESISTOR DEVICE

[75] Inventor: Michikazu Takeuchi, Akita, Japan

[73] Assignee: TDK Corporation, Tokyo, Japan

[21] Appl. No.: 647,032

[22] Filed: Sep. 4, 1984

[30] Foreign Application Priority Data

Sep. 9, 1983 [JP] Japan ..... 58-139929[U]

[51] Int. Cl.[4] ..... H01C 7/10

[52] U.S. Cl. ..... 338/22 SD; 338/22 R; 219/541

[58] Field of Search ..... 338/22 R, 22 SD, 327; 219/541, 338, 381, 543, 553

[56] References Cited

U.S. PATENT DOCUMENTS 3,245,019 4/1966 Heywang et al. ..... 338/22 R
3,268,844 8/1966 Bergsma ..... 338/22 R
4,232,214 11/1980 Shioi et al. ..... 219/541

*Primary Examiner*—E. A. Goldberg
*Assistant Examiner*—M. M. Lateef
*Attorney, Agent, or Firm*—Wyatt, Gerber, Shoup, Scobey & Badie

[57] ABSTRACT

A positive temperature coefficient (PTC) device, preventing silver migration effect and partial excessive heating, comprises a circular semiconductor PTC ceramic plate having a pair of first non-silver conductive layers attached on both surfaces of said PTC ceramics plate. A pair of second conductive layers, including silver, is attached on the first layers and an elongated periphery portion on the first layers is left without said second layers. A pair of conductive terminals couples the PTC element with an external circuit, each terminal having a convex portion to contact and support the PTC plate at the second layers so that the first layers do not directly touch with the terminals.

10 Claims, 8 Drawing Figures

PTC RESISTOR DEVICE

BACKGROUND OF THE INVENTION

The present invention relates to a PTC resistor device, which stands for a Positive Temperature Coefficient thermistor resistor. A PTC device is used as a current control device in a motor starter, an oil evaporation device in an oil furnace, a thermo-bottle, and/or a heater for a mosquito stick.

A PTC resistor has the characteristics that the resistance is high at high temperature, therefore, there is no danger of overheating of a heater, because power consumption is reduced automatically at high temperature. A PTC element is made of mainly barium titanate.

There have been some inventions relating to a PTC device. The U.S. Pat. No. 4,232,214 which is filed by the present assignee is one of them.

Conventionally, a PTC resistor has the structure comprising a flat PTC plate, silver electrode layers attached on both the surfaces of said PTC plate, and, a pair of electrodes coupled electrically with said silver layers. However, that conventional structure has the disadvantage of a silver migration effect, in which a silver molecule of a silver layer moves from the silver layer to the PTC plate along the outer surface of the plate when a voltage is applied between the electrodes of the PTC resistor, and the electrodes are finally short-circuited. That silver migration effect is considerable at high temperature condition. The silver migration effect could be overcome if the electode layers were replaced by a gold layer, platinum layer, or palladium layer, however, the replacement by those materials would cause the increase of the production cost of a PTC resistor, and therefore, these replacements are not preferable.

Another prior system for overcomig the silver migration effect is to provide an anti-silver migration barrier with another metal on a silver layer. However, that technique has the disadvantage that the production cost of a PTC resistor is also increased, and/or the barrier layer is not stable at high temperature.

Accordingly, we have developed a new structure of a PTC which is expected to be free from silver migration. The structure of that PTC device is shown in FIGS. 1 through 3, in which the PTC heater comprises the PTC plate 1, a pair of first conductive layers 2 which are made of a metal that is not silver and contact with the PTC plate with ohmic contact, and a second pair of conductive layers 3 which are made mainly of silver and are attached on the first layers so that a gap G is left at the peripheral circle of the first layers 2. That structure is free from silver migration, since the first layers which contact directly with the PTC plate is made of another metal, not silver, and the PTC plate holds the positive temperature coefficient characteristics since the first layers provide the ohmic contact with the PTC plate. Further, since the first layers 2 are provided on the whole surfaces of the PTC plate, the current density in the PTC plate can be uniform, and therefore, the heat generation in the PTC plate is also uniform. Those first layers 2 are provided through electroless plating process, ion plating process, sputtering process, or screen printing process.

Further, since second layers 3 are provided on the first layers 2, the conductivity of the combined electrodes are low in spite of the high conductivity of the second layers which include silver. It should be noted that the second layers which are made of silver do not contact directly with a PTC plate, since a gap G is provided at the peripheral of the layers, and therefore, the silver migration by the second layers is prevented. Preferably, the width of said gap space G is approximately 0.1~4 mm.

However, we found that the structure of FIGS. 1 and 2 has the disadvantage as described in accordance with FIG. 3, in which the numerals 4 and 5 are terminal electrodes for coupling the PTC heater with an external circuit, and said electrodes 4 and 5 contact with the second layers at almost all the area of the second layers. In the structure of FIG. 3, when the electrodes 4 and 5 are curved or deformed by high temperature due to the heating of the PTC resistor, the electrodes 4 and 5 might contact with the first layers only at the portion of the gap G. It should be noted that the resistance of the first layers is high since they are made of a metal that is not silver (some examples of the first layers are nickle, brass, or aluminum, and therefore, the contact resistance at the gap G between the electrodes 4 and 5, and the first layers is rather high, and therefore, the portion of the gap G is partially excessively heated. Then, the PTC heater itself is broken by that partial heat loss. That disadvantage comes from the partial contact of the electrodes 4 and 5 with the first layers at the gap G.

SUMMARY OF THE INVENTION

It is an object of the present invention to overcome the disadvantages and limitations of a prior PTC resistor by providing a new and improved PTC resistor.

It is also an object of the present invention to provide a PTC heater which is free from the silver migration effect, together with a partial excessive heating at the gap portion.

The above and other objects are attained by a PTC resistor device comprising a PTC resistor element having a semiconductor flat PTC plate with positive temperature coefficient resistance, a pair of first conductive layers attached on both the surfaces of said flat plate, and a pair of second conductive layers attached on said first conductive layers so that an elongated gap G where no second conductive layers is attached is provided at the peripheral of said first conductive layers, wherein said first layers are made of a metal that is not silver, and said second conductive layers are made of a metal of which main component is silver; a housing made of insulation material for mounting said PTC resistor element; a pair of terminals each having a connector chip, a convex poriton, and a central portion between said chip and said convex portion, said terminals being made of resilient conductive material; and said PTC resistor element being supported by said convex portions of said terminals so that said convex portions press said second layers.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
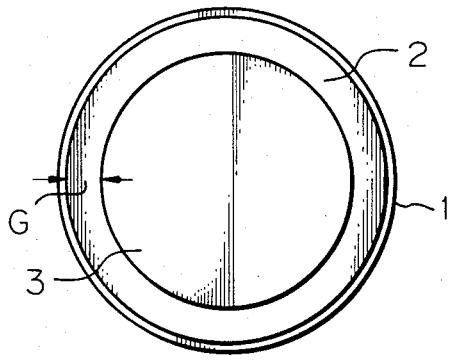
FIG. 1 is a plane view of a PTC resistor which is tried under the research of the present invention.
Figure 2:
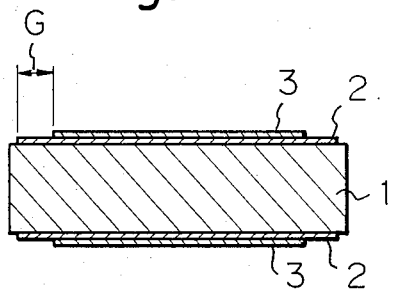
FIG. 2 is a cross section of the structure of FIG. 1.
Figure 3:
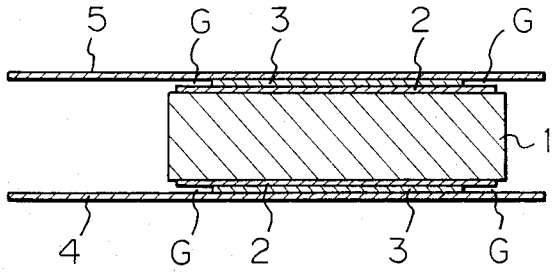
FIG. 3 is an assembled cross section of the PTC resistor of FIG. 1.
Figure 4:
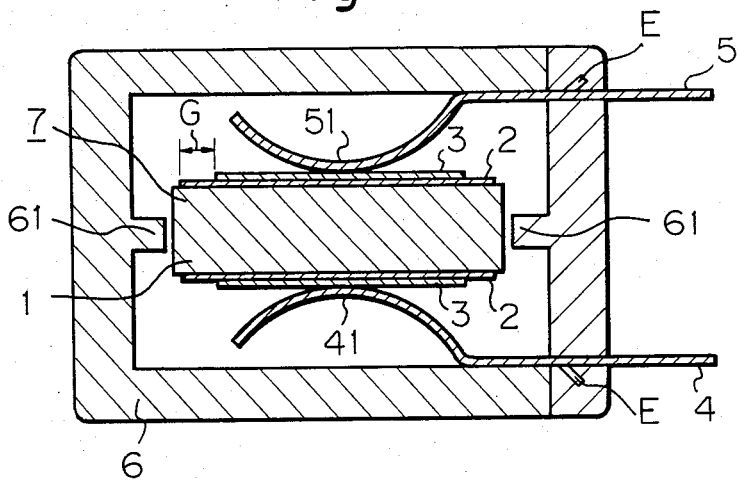
FIG. 4 is a cross section of the PTC resistor according to the present invention.

FIG. 4 shows the cross section of the PTC resistor according to the present invention, in which the same numerals as those in FIGS. 1 through 3 show the same members as those in those figures. In FIG. 4, the numeral 6 is closed insulation housing made of, for instance, plastics mold resin, and has a pair of projections 61 projected into the room of the housing. A pair of terminals 4 and 5 are fixed to the housing 6 so that one end of each terminals 4 and 5 is out of the housing 6, and the other end of those terminals 4 and 5 is curved or convex. Those terminals 4 and 5 are made of resilient material so that a spring action by the terminals is expected. The curved ends of those terminals face with each other so that the convex surfaces face with each other.

The PTC resistor 7 is supported between the convex portions 41 and 51 of said terminals 4 and 5 by the spring action of those terminals 4 and 5. The PTC resistor 7 comprises a flat PTC plate 1, a pair of first conductive layers 2 made of metal which is not silver attached on both the surfaces of the PTC plate 1 so that the layers 2 provide the ohmic contact with the PTC plate 1, a pair of second layers 3 made of mainly silver attached on said first layers 2. The second layer 3 made of silver is provided so that the total resistance of the layers 2 and 3 is low enough to provide uniform current density in a PTC resistor, and the contact resistance of the layers with a spring is low. As shown in FIG. 4, the area of the second layers is smaller than that of the first layers, and therefore, the elongated ring shaped gap space G is provided around the peripheral of the first layers, and it should be noted that no second layer material exists on said gap space G. Preferably, the width of said gap space G is about 0.1~4 mm.

The PTC resistor 7 is positioned between the projections 61 which prevents the lateral movement of the PTC resistor 7. Preferably, a small gap is left between the end of the PTC resistor 7 and each projection 61 so that the resistor 7 does not directly touch with the projections 61 by the thermal expansion of the resistor 7.

If the PTC resistor touched directly with the housing, the characteristics of the PTC resistor would be deteriorated because of the heat dissipation to the housing.

The shape of the gap G is O-ring shaped when a PTC resistor is circular, alternatively, it may be rectangular when a PTC resistor is rectangular.

Figure 5:
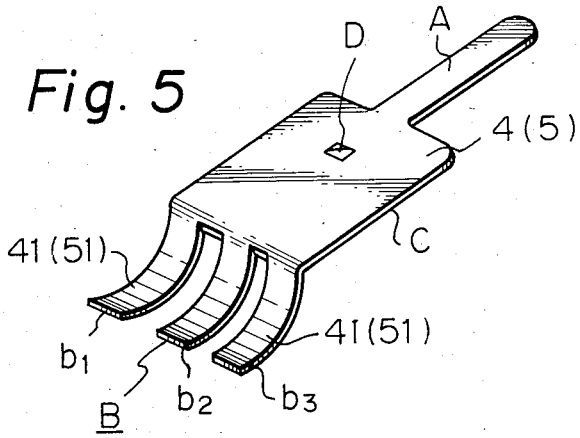
FIG. 5 is a perspective view of an electrode 41 and 51 in FIG. 4.

FIG. 5 shows the detailed structure of the terminals 4 and 5, which have an external tongue or connector chip A, for coupling with an external circuit, a convex end B, and a central portion C between said tongue A and said convex end B. Preferably, the convex end B comprises a plurality of parallel convex arms $a_1$, $a_2$ and $a_3$ by providing some slits between those arms. The central portion C may have a projection D which engages with the housing 6 for the positioning of the terminals 4 and 5 to the housing 6.

The convex ends 41 and 51 sandwich the PTC resistor 7 at approximately central portion of the PTC resistor as shown in FIG. 4, therefore, even when the terminals 4 and 5, and/or the PTC resistor 7 are deformed at high temperature, the terminals 4 and 5 do not touch with the first layers 2 at the gap portion G. Accordingly, no partial dense current, or no partial excessive heating caused by the direct contact between the first layers 2 and the terminals 4 and 5 occurs.

Figure 6:
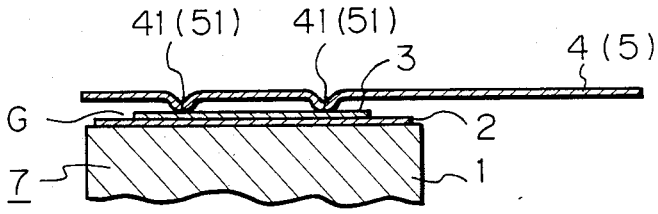
FIG. 6 is a modification of the present PTC resistor according to the present invention.

FIG. 6 shows the structure of another embodiment of the terminals 4 and 5, in which the terminals 4 and 5 has a plurality of convex projections 41 and 51, while the embodiment of FIGS. 4 and 5 has a single convex projection. The PTC resistor 7 is supported between the convex projections of a pair of terminals 4 and 5 by the spring action of those terminal leaves. A plural projections on the terminal leaves improve the stable positioning of the PTC resistor.

Figure 7:
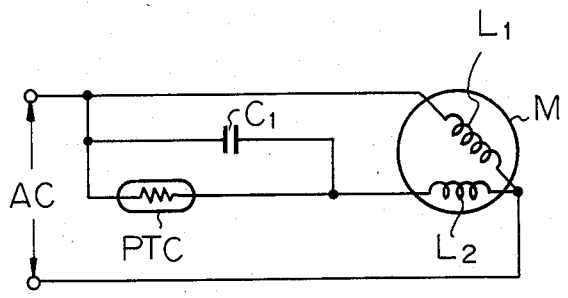
FIG. 7 is a circuit diagram of a motor starter which is one of the application of the present PTC device.

FIG. 7 is a circuit diagram of a motor starter which is one of the applications of the present PTC resistor device. In the figure, the symbol M is an induction motor, $L_1$ is a main winding of the motor M, $L_2$ is an auxiliary winding of the motor M, $C_1$ is a capacitor, $C_2$ is a starter capacitor, PTC is the present PTC device, and AC is the commercial alternate power source. Conventionally a contact switch has been used instead of said PTC device, and when the motor starts, said switch is switched OFF. That switch is replaced in the present invention by a PTC device, which has low resistance at low temperature, and that low resistance corresponds to a switch being ON. When the motor M starts, the current in the PTC device raises the temperature of the PTC device high, then, the resistance of the device becomes high. That high resistance corresponds to a switch being OFF. Accordingly, that PTC device functions as a switch in an induction motor starter circuit, and that has the advantage that no mechanical contact is used, and provides no spark.

Figure 8:
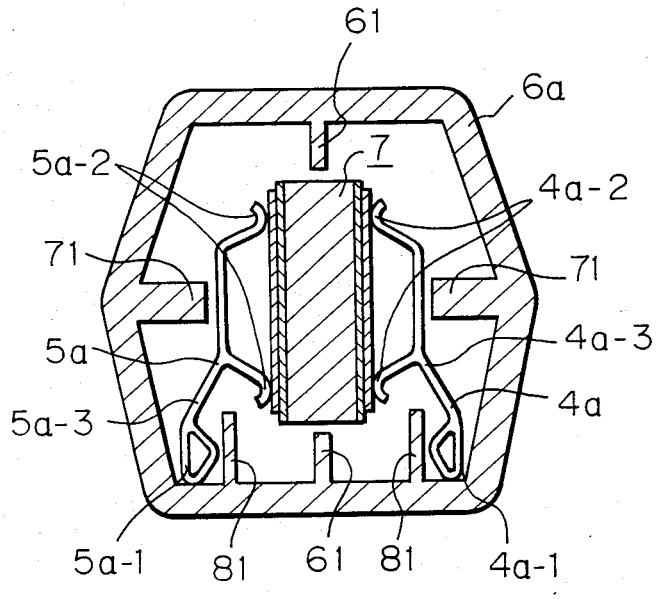
FIG. 8 is the cross section of the structure of the modification of the present PTC resistor device.

FIG. 8 is the cross section of the modification of the structure of the present PTC device. In the figure, the numeral **6*a* is a housing made of insulation material, having a pair of projections 61 for preventing the movement of the PTC element 7, and another pair of projections 71 which also prevents the movement of the element 7. The PTC element 7 is secured in the room defined by those projections 61 and 71 by the spring action of the resilient terminals 4*a* and 5*a*. Each of those terminals 4*a* and 5*a* has a substantially U-shaped portion which has a pair of convex ends (4*a*-2, 5*a*-2), a connector chip (4*a*-1, 5*a*-1), and a central portion (4*a*-3, 5*a*-3) for coupling the connector chip and the U-shaped portion with convex ends. The connector chip (4*a*-1, 5*a*-1) is secured in a room defined by the projection 81**, and functions to couple the PTC device with an external circuit by accepting an external pin in the connector chip.

As a modification, the shape of a PTC resistor may be hollow cylindrical, instead of a flat plate. In case of a cylindrical shape, the electrode layers are attached on the outer surface and the inner surface of the cylindrical body, and of course a pair of ring shaped gap spaces where no silver layer exists are provided at both the ends of the cylindrical body.

As described above in detail, according to the present invention, a silver migration effect resulting from using a silver electrode is completely prevented, and at the same time, the partial excessive heating by the direct contact between an external terminal and first layers is also prevented. Thus, a PTC resistor with high operational reliability with no silver migration and no excessive heating is obtained.

From the foregoing, it will now be apparent that a new and improved PTC resistor has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A positive temperature coefficient (PTC) resistor device comprising:

(a) a PTC resistor elemetn having a semiconductor PTC, ceramics plate (7) with positive temperature coefficient resistance comprising a flat plate having opposite surfaces, a pair of first conductive layers (2) attached on both said opposite surfaces, and a pair of second conductive layers (3) each attached on a respective first conductive layer, (b) a housing (6) of insulation material in which said PTC resistor element is mounted, (c) a pair of terminals in said housing, each terminal having a connector chip (4,5) extending outside of the housing for coupling the PTC resistor device with an external circuit, each terminal having a convex portion (41,51) and a central portion between said connector chip and said convex portion, said terminals being of a resilient conductive material and said convex portion having a spring action, wherein the improvements comprise:

(d) the size of each of said second layers (3) is smaller in area than that of said respective first layer (2) to which it is attached so that a gap space G is provided at the peripheral portion of each of said first conductive layers (2), where the respective second conductive layer (3) does not extend;

(e) said first layers (2) are of metal that is not silver, and said second conductive layers (3) are of metal, the main component of which is silver, and (f) said PTC resistor element is supported by said convex portions of said pair of terminals with spring action so that said convex portions press said second layers and do not contact said first layers.

2. A PTC resistor device according to claim 1, wherein said convex portion of said terminals has a plurality of parallel convex arms.

3. A PTC resistor device according to claim 1, wherein said housing has a pair of projections projected inward of the housing so that those projections prevent movement of the PTC heater element.

4. A PTC resistor device according to claim 1, wherein each of said terminals has a plurality of convex portions along the longitudinal direction of the terminal.

5. A PTC resistor device according to claim 1, wherein said central portion of the terminals has a projection which is engaged with the housing so that the terminal is fixed rigidly to the housing.

6. A PTC resistor device according to claim 1, wherein said PTC resistor element is in a circular shape.

7. A PTC resistor device according to claim 1, wherein wdith of said gap G# is approximately 0.1~4 mm.

8. A PTC resistor device according to claim 1, wherein said gap space is in circular ring shaped.

9. A PTC resistor device according to claim 1, wherein said gap space is rectangular.

10. A PTC resistor device according to claim 1, wherein said PTC palte is a flat plate.

* * * * *